US006581697B1

(12) United States Patent
Giardino

(10) Patent No.: US 6,581,697 B1
(45) Date of Patent: Jun. 24, 2003

(54) POWER IMPACT TOOL TORQUE APPARATUS

(75) Inventor: David A. Giardino, Rock Hill, SC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 6 days.

(21) Appl. No.: 10/058,724

(22) Filed: Jan. 28, 2002

(51) Int. Cl.[7] ..... B25B 19/00

(52) U.S. Cl. ..... 173/1; 173/178; 173/93; 173/171; 173/176; 81/52; 81/467

(58) Field of Search ..... 173/176, 178, 173/181, 93, 93.5, 93.6, 104, 131, 171; 81/467, 470, 52, 58.3, 477

(56) References Cited

U.S. PATENT DOCUMENTS

| | | | | |
|---|---|---|---|---|
| 2,822,677 A | * | 2/1958 | Reynolds | 173/93.6 |
| 2,909,047 A | | 10/1959 | Walterscheid-Muller et al. | |
| 3,425,314 A | | 2/1969 | Ohlson | |
| 3,592,087 A | | 7/1971 | Pauley | |
| 3,832,916 A | * | 9/1974 | Schoeps | 81/477 |
| 3,948,328 A | | 4/1976 | Hiraoka et al. | |
| 4,019,589 A | | 4/1977 | Wallace | |
| 4,176,582 A | | 12/1979 | Witte | |
| 4,287,956 A | | 9/1981 | Maurer | |
| 4,379,492 A | * | 4/1983 | Hiraoka | 173/181 |
| 4,691,786 A | | 9/1987 | Fujita et al. | |
| 5,090,532 A | | 2/1992 | Bich | |
| 5,297,458 A | | 3/1994 | Smith et al. | |

* cited by examiner

*Primary Examiner*—Scott A. Smith
(74) *Attorney, Agent, or Firm*—Schmeiser, Olsen & Watts

(57) ABSTRACT

A pneumatic tool apparatus, a pneumatic tool, and a method of making and using a pneumatic tool apparatus is disclosed. The apparatus has an inner torsion bar and an outer tube which has recesses which allow the apparatus to provide more torque in one direction of rotation than in the other direction of rotation.

25 Claims, 4 Drawing Sheets

POWER IMPACT TOOL TORQUE APPARATUS

FIELD OF INVENTION

This invention relates generally to the field of power impact tools and, more particularly, to a power impact tool torque apparatus which adjusts torque.

BACKGROUND OF INVENTION

Power impact tools (e.g., pneumatic, hydraulic, electric, etc.) are well known in the art. In general, torque applied to a workpiece (e.g., nut, bolt, etc.) is the same regardless of the direction of rotation of the power impact tool. Frequently, however, greater torque is required to crack seized nuts or loosen nuts in the reverse direction of rotation than in the forward direction. Similarly, often a workpiece will have a torque specification which spells out the maximum amount of torque allowed for tightening workpieces in order to avoid overtorquing; and, thereby stripping a threaded workpiece during tightening.

Currently, a separate torsion bar kit may be purchased and attached to the power impact tool. These torsion bar kits can reduce the torque ultimately transmitted to a workpiece from the amount of torque that the power impact tool (i.e., motor and clutch combination) puts out. Unfortunately, a shortcoming of these torsion bar kits is that they are manufactured and marketed for attachment to a single make, model, and size power impact tool. That is, while they technically reduce the torque output of a power impact tool by a fixed quantity of torque, the user is only informed of the ultimate amount of torque applied to a workpiece by the specific power impact tool and torsion bar kit combination. For example, if the user takes a torsion bar kit sold as a "twenty foot-pound torsion bar kit" and attaches it to the correct, applicable power impact tool, twenty foot-pounds of torque will ultimately be applied to the nut. Thus, in this case, suppose the specified, applicable pneumatic wrench is rated at one hundred foot-pounds of torque output, the amount of torque ultimately applied to a nut by the impact wrench would ultimately be twenty foot-pounds in either direction of rotation. This is because this specific torsion bar kit, although marketed and labeled as a "twenty foot-pound torsion bar kit" is not automatically reducing the torque ultimately applied to a nut to twenty foot-pounds, but is actually reducing the torque output of the impact tool to that applied to the workpiece by eighty foot-pounds (i.e., 100 minus 80). Unfortunately, as is often the case, the user will take this same torsion bar kit and attach it to a different impact tool. For example, the user will then attach this same "twenty foot-pound torsion bar kit" to a torque wrench, rated at one hundred forty foot-pounds of torque output. The user mistakenly believes that this combination of torsion bar kit and power torque wrench again results in twenty foot-pounds of torque being ultimately applied to a workpiece. This is incorrect. In fact, this new combination results in sixty foot-pounds being applied to the workpiece (i.e., 140 minus 80). Again, this is because the torsion bar kit reduces torque output by eighty foot-pounds. Frequently, because the user does not know what the torque output rating of a particular power impact tool; the user is constantly moving the torsion bar kit from one power impact tool to another; and, the user believes that the torsion bar kit automatically reduces torque applied to a workpiece to a fixed amount, ultimately results in the user being unable to determine the amount of torque being actually applied to the workpiece. As a result, workpieces may be overtorqued or undertorqued, ultimately being destroyed in the process. These aftermarket torsion bar kits suffer from several shortcomings, including that the exact total torque transmitted to a workpiece is frequently unknown and the amount of torque applied to the workpiece is the same in both directions of rotation.

Accordingly, there is a need in the field of power impact tools for ways to provide more predictable amounts of torque ultimately applied to a workpiece in both directions. Additionally, there is a need for an apparatus to provide greater torque in a single direction of rotation in a more predictable quantity for use with power impact tools.

SUMMARY OF INVENTION

The present invention provides an apparatus and method for use with power impact tools.

A first general aspect of the invention provides an apparatus for a power impact tool comprising:

a torsion bar;

an outer tube operatively attached to said torsion bar, said outer tube having recesses shaped to allow greater torque transmission in a first direction than in a second direction.

A second general aspect of the invention provides an apparatus comprising:

an outer tube having a plurality of inwardly extending driving surfaces;

a torsion bar with a plurality of receiving surfaces on the exterior thereof;

wherein said driving surfaces are in driving engagement with said receiving surfaces upon rotation in a first direction only.

A third general aspect of the invention provides an apparatus comprising:

a torsional spring with a plurality of extensions on an exterior thereof;

an outer cylinder having a bore with a plurality of inwardly extending recesses on an interior surface thereof;

wherein said plurality of inwardly extending recesses allow greater purchase with said torsional spring upon a nut loosening rotation.

A fourth general aspect of the invention provides a power impact tool comprising:

a housing;

an air motor within said housing;

a torsion bar operatively attached to said air motor; and an outer tube operatively attached to said torsion bar, said outer tube having recesses shaped to allow greater torque in a first direction than in a second direction.

A fifth general aspect of the invention provides a power impact tool comprising:

a housing;

an air motor contained within said housing, wherein said air motor provides a first torque output; and a torque control system comprising an outer tube surrounding a torsion bar, wherein said torque control system is operatively attached to said air motor, wherein said torque control system changes said first torque output to a second torque output.

A sixth general aspect of the invention provides a method of making an apparatus for a power impact tool comprising:

providing a torsion bar; and attaching an outer tube to said torsion bar, said outer tube having recesses shaped to allow more torque transmission in a first direction of rotation than in a second direction of rotation.

A seventh general aspect of the invention provides a method of using a power impact tool apparatus comprising:

Providing a torsion bar;

attaching an outer tube to said torsion bar, said outer tube having recesses being shaped to allow more torque transmission in a first direction of rotation than in a second direction; and attaching said torsion bar to a workpiece.

The foregoing and other features of the invention will be apparent from the following more particular description of various embodiments of the invention.

BRIEF DESCRIPTION of DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

This device is used with, or as part of, a power impact tool and allows for greater torque in a one direction of rotation than in the second direction of rotation. Power impact tools can include various power (e.g., pneumatic, hydraulic, electric, etc.) impact tools. Typically, more torque is required, on occasion, in the reverse, or nut loosening, direction. The device provides increased torque in reverse, for cracking and loosening seized nuts or bolts. This device, when used with a power impact tool, for example with a pneumatic impact wrench, also provides torque control, in that it provides a fixed quantity of reduction of torque from the amount that an air motor within the tool puts out, to a second, lower amount of torque that is ultimately applied to a workpiece, such as a nut or bolt.

For every blow or impact exerted by a power impact tool 11, the power impact tool 11 puts out a fixed amount of rotational kinetic energy. A torsion bar 20, which acts as a type of torsional spring, when attached to the power impact tool 11 soaks up or takes up a portion, or percentage of this outputted rotational kinetic energy. Thus, the torsion bar 20 acts to reduce some of the rotational kinetic energy that is ultimately applied to a workpiece from the amount that the power impact tool 11 (i.e. motor and clutch combination) puts out.

Figure 3:
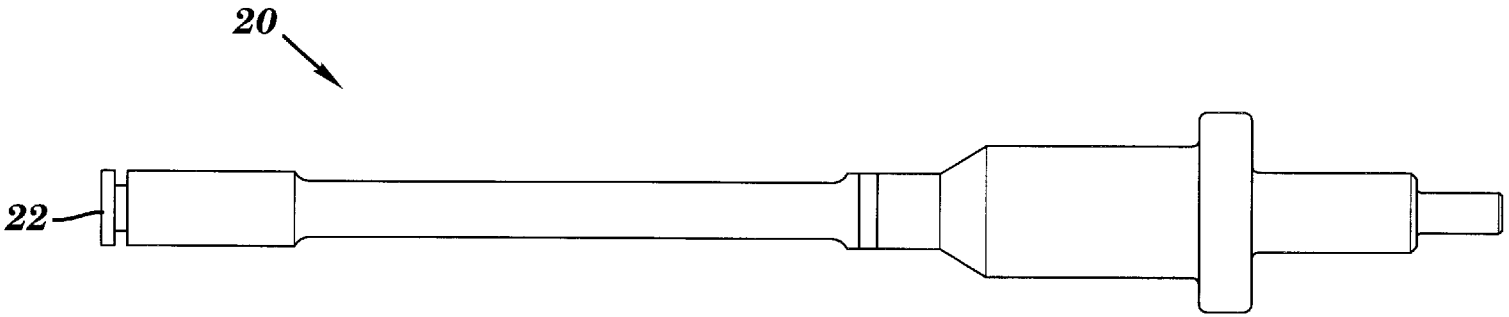
FIG. 3 depicts a side view of a torsion bar of a power impact tool torque apparatus, in accordance with an embodiment of the present invention.

Referring to the drawings, FIG. 3 depicts a cross-section of a torsion bar 20, in accordance with the present invention. A torsion bar 20 (e.g., torque bar, drive bar, etc.) is an elongate rotatable device which transmits force at a radial distance from the center of rotation. The torsion bar 20 is a type of rotating torque means or torsional spring. A torsion bar 20 may be, for example, an attachment for an anvil of power impact wrench, an attachment for a nut runner, etc. The torsion bar 20 is operatively attached to the power impact tool 11 (see FIG. 1) at one end, and is attached to the workpiece (e.g., nut, bolt, etc.) at the other end. The torsion bar 20 may be cylindrical in shape, or have other cross-sectional shapes. The torsion bar 20 may neck, or narrow down in the middle section of its length. The torsion bar 20 acts, in part, as a spring, whereby some of the torque emitted from the power impact tool 11 is passed from the power impact tool 11 through the torsion bar 20 onto the workpiece, while some of the torque emitted from the power impact tool 11 is taken up by the spring action of the torsion bar 20 itself and not passed through to the workpiece. Thus, the torsion bar 20 provides a reduction in the amount of torque from the torque output of the motor to the amount of torque applied directly to the workpiece. The shape, configuration, amount of narrowing, temperature, and material of the torsion bar 20 all determine this fixed quantity of torque reduction that a specific torsion bar 20 provides.

An added advantage of this device, is that by providing a torsion bar 20 that is integrally or fixedly attached to a specific power impact tool 11, the user will always know the specific amount of total torque being applied to the actual workpiece regardless of direction of rotation. This is because the torque output of the power impact tool 11 is known and the torque reduction of the apparatus 10 is known, as well. Because these elements are integrated, the amount of torque applied to the workpiece is a known and fixed quantity.

Figure 1:
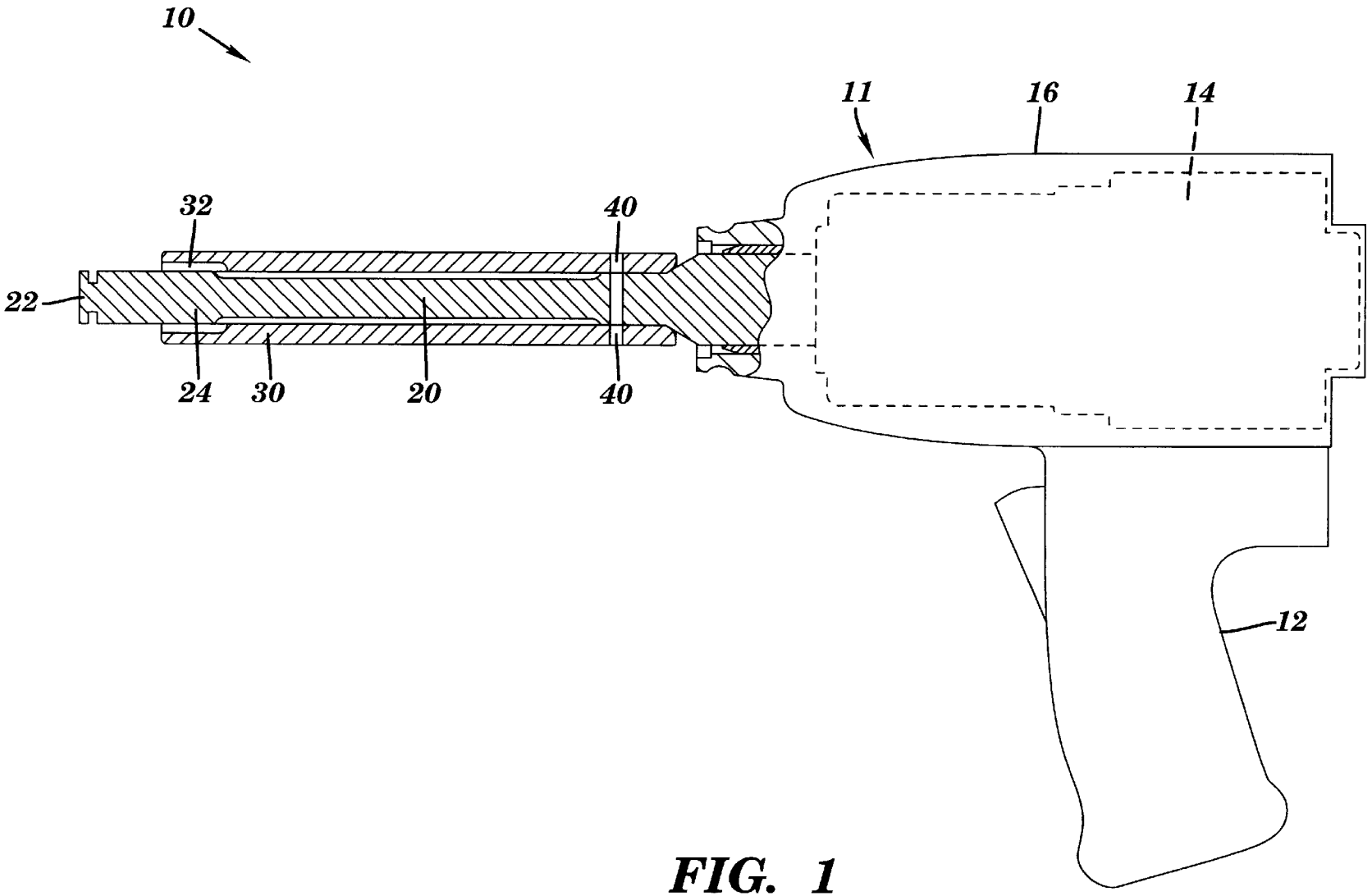
FIG. 1 depicts a cross-sectional view of a power impact tool torque apparatus, in accordance with the present invention.
Figure 2:
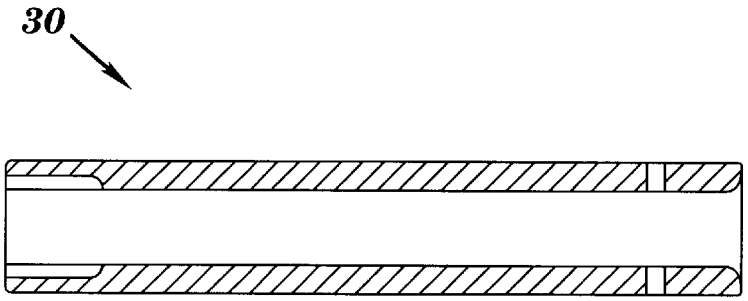
FIG. 2 depicts a cross-sectional view of an outer tube of a power impact tool torque apparatus, in accordance with an embodiment of the present invention.

In FIG. 1 a cross-sectional view the power impact tool torque apparatus 10 attached to a power impact tool 11 is depicted, including generally a handle 12 fixedly attached to a housing 16 with an air motor 14 housed therein. Note that FIGS. 1 and FIGS. 2 are sectional views taken along sectional line denoted by "2—2" in FIG. 4. Extending from the housing 16 and communicating with the air motor 14 is the torsion bar 20. The torsion bar 20 can either be fixedly or removably attached to the power impact tool 11. Operatively attached to the torsion bar 20 is an outer tube 30. The outer tube, torque tube, or outer torque tube 30 is connected to the torsion bar 20 via a set of keeper pins 40 which keeps the outer tube 30 attached to the torsion bar 20 during use. This keeper pin 40, or plurality of keeper devices, connection may be located anywhere along the length of the outer tube 30 and torsion bar 20. An alternative embodiment can have the outer tube 30 and the torsion bar 20 connected to the power impact tool 11. Similarly, the outer tube 30 alone can be connected to the power impact tool 11. At the end of the torsion bar 20 that is opposite to the power impact tool 11 is a socket end 22 where various workpiece interfaces (e.g., socket, drill bit, etc.) may be attached. Extending radially from the exterior of the torsion bar 20 are a plurality of extensions 24 (see FIG. 4), or receiving surfaces. The extensions 24 can be flat, square-shaped, polygon-shaped, or other shape and configuration to allow suitable operational attachment to parts of the adjacent outer tube 30.

FIG. 2 depicts a cross section of the outer tube 30 separated from the torsion bar 20. The outer tube 30 can be a cylinder with an axial bore therein. The outer tube 30 surrounds the torsion bar 20 so that both items share the same axis of rotation. Interspersed and extending inwardly on the interior face, or surface, of the outer tube 30 are driving surfaces 34 and recesses 32. The driving surfaces 34 may be flat or other shape and can extend radially inwardly from the interior face of the outer tube 30. Similarly, the recesses 32 can be of a plurality of shapes and locations. The recesses 32 can be curved, round, spiral-shaped, etc. or similar shape. Specific curved shapes of the recesses 32 include a parabolic spiral, logarithmic spiral, hyperbolic spiral, involute of a circle, spiral of Archimedes, etc. The shape and location of the recesses 32, the adjacent driving surfaces 34 on the outer tube 30, and the corresponding extensions 24 on the torsion bar 20 can be adjusted and varied so long as the configuration and placement of all three allow for unified rotation of both torsion bar 20 and outer tube 30 in one direction of rotation, yet disallows, or lessens, rotation of the outer tube 30 in comparison with the torsion bar 20 in the second direction of rotation.

Figure 4:
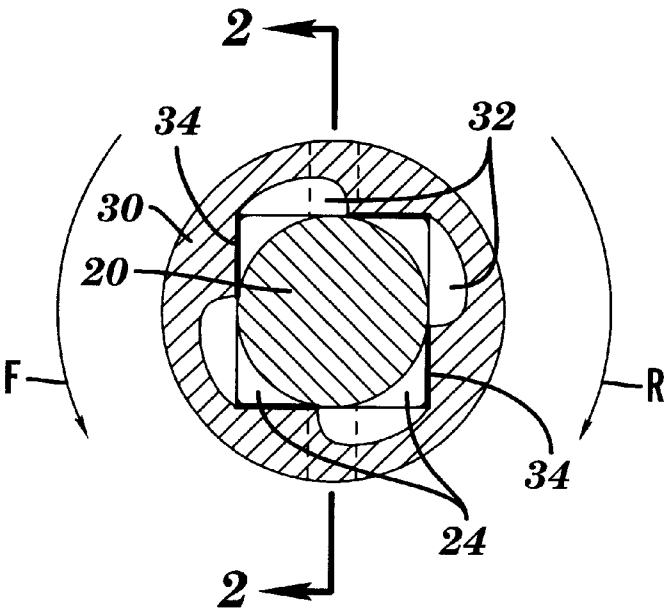
FIG. 4 depicts an end view of a power impact tool torque apparatus, in accordance with an embodiment of the present invention.

FIG. 4 depicts an end view of the power impact tool torque apparatus 10. In the embodiment shown, the end of the torsion bar 20 nearest a workpiece has square-shaped extensions 24 extending laterally from the exterior of the torsion bar 20. These plurality of extensions 24 communicate with the driving surfaces 34 on the outer tube 30 that are interspersed with the recesses 32 on an interior surface of the outer tube 30. Upon rotation of the power impact tool 11, and thus the outer tube 30 and torsion bar 20 in the reverse direction, denoted by directional arrow "R", the flat driving surfaces 34 of the outer tube 30 contact and develop purchase with the receiving surfaces 24 of the torsion bar 20. Thus, upon reverse rotation, the apparatus 10 benefits from the increased driving torque, and mass, of both the inner torsion bar 20 and the outer tube 30. Both torsion bar 20 and outer tube 30 rotate in unison. The apparatus 10 allows for greater torque transmission, ultimately to the workpiece, in reverse than in forward.

Figure 5:
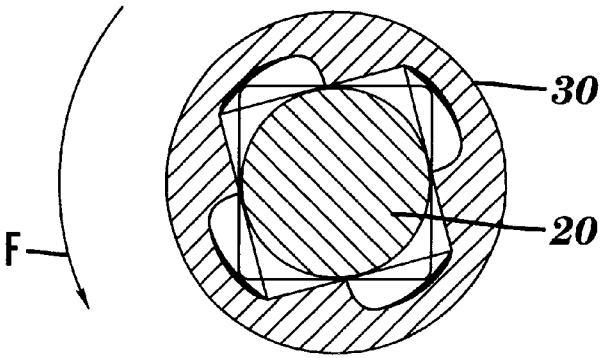
FIG. 5 depicts an end view of a power impact tool torque apparatus rotating in a forward direction, in accordance with an embodiment of the present invention; and, FIG. 6 depicts a cross-sectional view of an alternative embodiment of a power impact tool torque apparatus, in accordance with an embodiment of the present invention.

Conversely, when the power impact tool 11 is driven in the forward direction (also see FIG. 5), denoted by directional arrow "F", a different, lesser amount of torque is ultimately applied to the workpiece. Although, upon initial rotation of the tool motor 14 the outer tube 30 may initially slightly rotate along with the torsion bar 20. However, as the outer tube 30 attempts to further rotate along with the torsion bar 20, because of the recesses 32 located on the outer tube 30 the outer tube 30 cannot develop purchase with and can no longer drive the receiving surfaces 24 on the torsion bar 20. The recesses 32 allow rotation of the outer tube 30 around the torsion bar 20. The outer tube 30 will not rotate in unison with the torsion bar 20 in forward rotation. Thus, the mass of the outer tube 30 and any torque therein, cannot be transmitted from the outer tube 30 to the inner torsion bar 20, and ultimately passed on through to the workpiece. As a result, when the apparatus 10 is rotated in the forward direction less torque will be ultimately applied to a workpiece than during reverse rotation. Thus, in the forward direction, only the torsion bar 20 transmits torque to the workpiece. Conversely, in the reverse direction, the greater torque and mass of both the torsion bar 20 and outer tube 30 is applied to the workpiece. The recesses 32, in part, allow for less torque to be transmitted in the forward direction and for greater torque to be transmitted in the reverse direction.

The apparatus 10 is a form of a torque control system whereby the torsion bar 20 and outer tube 30, when operatively attached to a motor 14 of a power impact tool 11, can control and reduce the amount of torque ultimately applied to a workpiece from the torque generated by the motor 14. In addition, this torque control system provides a different amount of torque in one direction of rotation than the other direction of rotation.

Figure 6:
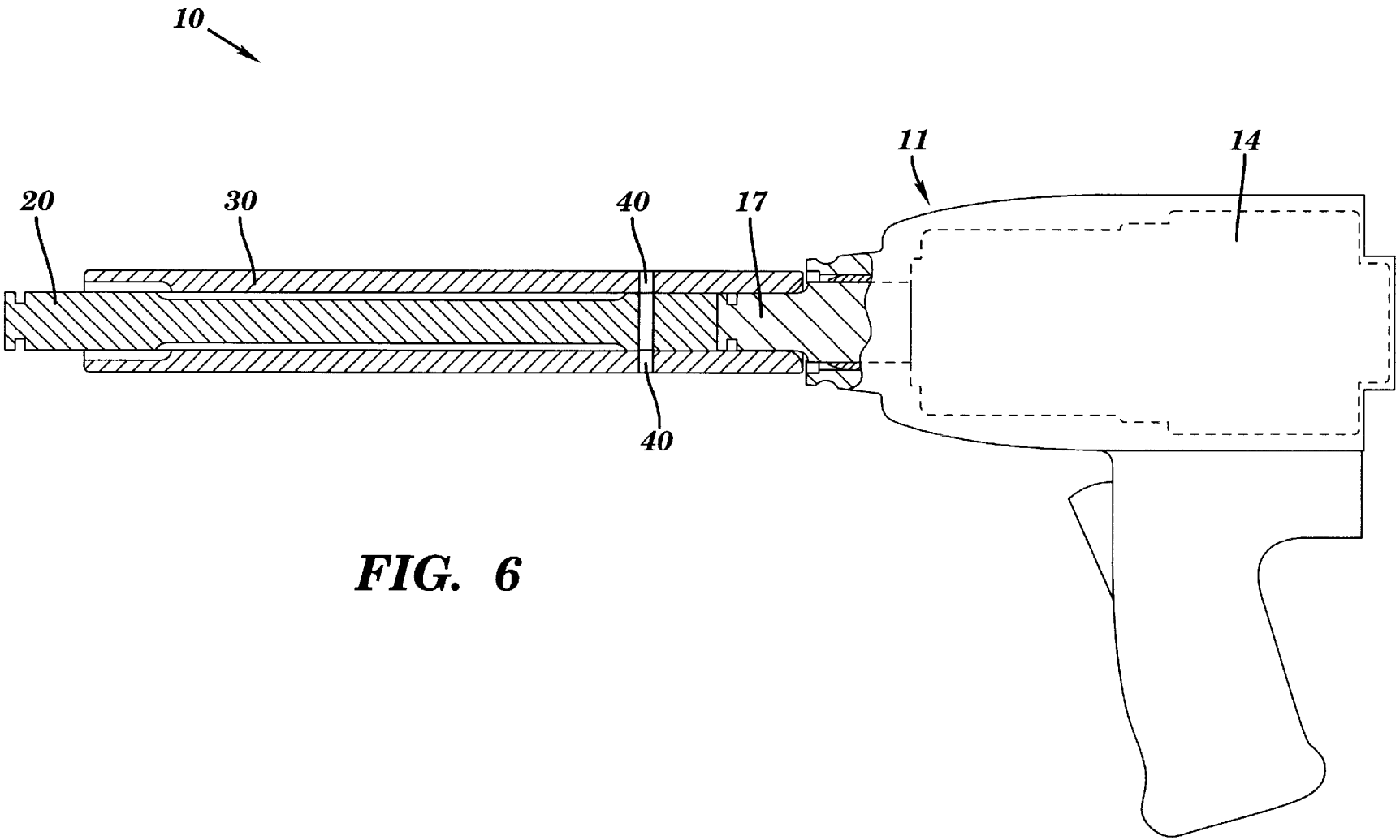

Although the power impact tool torque apparatus 10 of the present invention describes an invention in which the torsion bar 20 and/or the outer tube 30 are fixedly attached to the power impact tool 11 and/or tool housing 16, it should be clear to one of ordinary skill in the art of power impact tools that the torsion bar 20 and/or outer tube 30 could also be releasably attached to the power impact tool 11. This would be a separate detachable torque kit for retrofitting to preexisting power impact tools. FIG. 6 depicts a sectional view of alternative embodiment showing a torque system, or kit, whereby an existing power impact tool 11 can be retrofitted. In this embodiment, both the torsion bar 20 and outer tube 30 are configured in order to fit around a drive extension of an existing power impact tool 11.

Additionally, it should be clear to one of ordinary skill in the art of power impact tools that alternative embodiments are possible whereby rather than having the flat, square-shaped extension 24 on the torsion bar 20 similar polygon, splines, and other geometric configurations are possible that provide a similar uni-directional purchasing interface with the various driving surfaces 34 and recesses 32 on the outer tube 30. Further, although the embodiment depicted provides greater torque in the reverse (i.e., nut-loosening rotation), it should be clear to one of ordinary skill in the art of power impact tools that an alternative embodiment could provide for an apparatus 10 wherein the greater torque is provided for tightening (i.e. forward rotation). This embodiment could be attained, for example, by reversing the direction of the driving surfaces 34 on the outer tube 30.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. An apparatus for a power impact tool comprising:

a torsion bar;

an outer tube operatively attached to said torsion bar, said outer tube having recesses shaped to allow greater torque transmission in a first direction than in a second direction.

2. An apparatus as in claim 1, wherein said recesses are located on an interior face of said outer tube.

3. An apparatus as in claim 1, wherein said recesses are curved.

4. An apparatus as in claim 3, wherein said recesses are spiral-shaped.

5. An apparatus as in claim 4, wherein said recesses are shaped from the group consisting of: involute of a circle, spiral of Archimedes, hyperbolic spiral, logarithmic spiral, and parabolic spiral.

6. An apparatus as in claim 1, wherein said first direction is a nut loosening direction.

7. An apparatus as in claim 1, wherein at least one of said outer tube and said torsion bar is releasably attached to the pneumatic tool.

8. An apparatus as in claim 1, wherein at least one of said outer tube and said torsion bar is fixedly attached to the pneumatic tool.

9. An apparatus comprising:

an outer tube having a plurality of inwardly extending driving surfaces;

a torsion bar with a plurality of receiving surfaces on the exterior thereof;

wherein said driving surfaces are in driving engagement with said receiving surfaces upon rotation in a first direction only.

10. An apparatus as in claim 9, wherein said plurality of inwardly extending driving surfaces extend radially from an interior surface of said outer torque tube.

11. An apparatus as in claim 9, wherein said plurality of inwardly extending driving surfaces are flat.

12. An apparatus as in claim 9, wherein said plurality of receiving surfaces are flat.

13. An apparatus as in claim 12, wherein said receiving surfaces are square-shaped.

14. An apparatus as in claim 9, wherein said first direction is a reverse direction.

15. An apparatus comprising:

a torsional spring with a plurality of extensions on an exterior thereof;

an outer cylinder having a bore with a plurality of inwardly extending recesses on an interior surface thereof;

wherein said plurality of inwardly extending recesses allow greater purchase with said torsional spring upon a nut loosening rotation.

16. An apparatus as in claim 15, wherein said torsional spring is a torsion bar.

17. A power impact tool comprising:

a housing;

an air motor within said housing;

a torsion bar operatively attached to said air motor; and an outer tube operatively attached to said torsion bar, said outer tube having recesses shaped to allow greater torque in a first direction than in a second direction.

18. A power impact tool as in claim 17, wherein said first direction is a reverse direction.

19. A power impact tool comprising:

a housing;

an air motor contained within said housing, wherein said air motor provides a first torque output; and a torque control system comprising an outer tube surrounding a torsion bar, wherein said torque control system is operatively attached to said air motor, wherein said torque control system changes said first torque output to a second torque output.

20. A power impact tool as in claim 19, wherein said second torque output is less than said first torque output.

21. A power impact tool as in claim 20, wherein said outer tube has a plurality of inwardly extending driving surfaces on an interior surface thereof; and said torsion bar has plurality of receiving surfaces on an exterior thereof;

wherein said driving surfaces are in driving engagement with said receiving surfaces upon rotation in a single direction only.

22. A method of making an apparatus for a power impact tool comprising:

providing a torsion bar; and attaching an outer tube to said torsion bar, said outer tube having recesses shaped to allow more torque transmission in a first direction of rotation than in a second direction of rotation.

23. A method of using a power impact tool apparatus comprising:

providing a torsion bar;

attaching an outer tube to said torsion bar, said outer tube having recesses being shaped to allow more torque transmission in a first direction of rotation than in a second direction; and attaching said torsion bar to a workpiece.

24. A method as in claim 23, further comprising:

rotating at least one of said torsion bar and said outer tube.

25. A method as in claim 23, further comprising:

attaching at least one of said torsion bar and said outer tube to a power impact tool.

* * * * *